US006126006A

United States Patent [19]

Addy et al.

[11] Patent Number: 6,126,006

[45] Date of Patent: Oct. 3, 2000

[54] LIGHT-TIGHT PACKAGE WITH CIRCUMFERENTIALLY PERFORATED END DISCS

[75] Inventors: John Addy, Kings Lanley; Barry Kruger, Kenton, both of United Kingdom

[73] Assignee: Eastman Kodak Company, Rochester, N.Y.

[21] Appl. No.: 09/384,397

[22] Filed: Aug. 27, 1999

[30] Foreign Application Priority Data

Aug. 28, 1998 [GB] United Kingdom ..... 9818724

[51] Int. Cl.[7] ..... B65D 85/67

[52] U.S. Cl. ..... 206/410; 206/413

[58] Field of Search ..... 206/397, 410, 206/413–416, 455; 229/87.05

[56] References Cited

U.S. PATENT DOCUMENTS 5,133,171 7/1992 Chase et al. .
5,515,970 5/1996 Ritchie et al. .
5,526,930 6/1996 Spina ..... 206/410
5,655,659 8/1997 Kennedy .
5,941,387 8/1999 Rasel ..... 206/413
5,944,186 8/1999 Sakai et al. ..... 206/397

FOREIGN PATENT DOCUMENTS 0 828 185 3/1998 European Pat. Off. .

*Primary Examiner*—Bryon P. Gehman
*Attorney, Agent, or Firm*—Frank Pincelli

[57] ABSTRACT

A light-tight package for a roll (1) of light sensitive material has a central core (4) around which the material is wound, a flexible opaque leader (6) having a leading end attached to the outermost end of the material and a pair of flexible end discs (7,8) covering each end of the roll. Each end disc has an outer diameter greater than the outer diameter of the roll to provide peripheral portions which are folded axially inwardly against the outer surface of the roll. A concentric ring of perforations is provided within the peripheral portion to control the tear and ensure that any portions of material left by the tear will not interfere with rewinding of the roll.

5 Claims, 1 Drawing Sheet

LIGHT-TIGHT PACKAGE WITH CIRCUMFERENTIALLY PERFORATED END DISCS

FIELD OF THE INVENTION

This invention relates to the field of packages for rolls of web material, in particular to rolls of light sensitive materials such as photographic paper and film.

BACKGROUND OF THE INVENTION

Rolls of light sensitive paper and film require light-tight packaging so that they are not exposed to daylight prior to use. However, the rolls should be packaged such that they can be loaded into co-operating apparatus under daylight conditions. Furthermore, the packaging must not adversely affect the ease of rotation of the roll during unwinding and must not interfere with the roll if the web is rewound back onto the roll.

U.S. Pat. No. 5,133,171 discloses a package which includes a pair of opaque flexible end discs attached to the ends of the core of the roll of material and an opaque leader attached to the leading end of the length of material forming the roll. After a first convolution of the leader is wrapped onto the roll peripheral portions of each end disc are folded over the first convolution. A second convolution is then wrapped onto the roll to capture the folded over portions between the first and second convolutions of the leader. No adhesive is used, friction being relied upon to hold the folded over portions between the convolutions.

U.S. Pat. No. 5,515,970 discloses a package having similar opaque end discs and leader. In this case the folded over portions of the end discs are held in place by adhesive tape strips.

U.S. Pat. No. 5,655,659 discloses a package having an opaque leader wound around the roll. Folded over portions of the end discs have radially arranged perforations and are held in place by adhesive tape strips.

In the above packages the end discs tear circumferentially at the edge of the roll when the leader is pulled. The perforations are provided to aid in initiating a tear. Sometimes when the package is opened this tear deviates from the preferred direction. This unsatisfactory tear can result in part of the outer diameter remaining untorn and forming "ears." These ears impede the rewinding of the roll. Unsatisfactory tearing can also lead to entry of light into the package and fogging of the light sensitive material.

The end discs of the light-tight package must be tearable when the leader is pulled. However it is a requirement that the disc tears circumferentially in such a way that no ears remain to impede rewinding of the package. The invention therefore aims to provide a light-tight package having end discs, the outer portions of which will tear in a more controlled manner when the leader is pulled such that any ears that do remain do not interfere with rewinding of the package.

SUMMARY OF THE INVENTION

An objective of the invention is to provide an improved light-tight package, which remains properly closed until opened during room light loading.

Another object of the present invention is to provide such a package wherein a low force is required to initiate and propagate a tear in the elements of the package and the resulting tear is clean.

Still another object of the present invention is to provide such a package the elements of which do not interfere with dispensing of the web material after opening of the package.

A further object of the present invention is to provide such a package that is not complex and can be easily manufactured.

The aim of the invention is to provide a light-tight package having end discs which when torn give a good circumferential tear and do not leave any ears or appendages which would interfere with dispensing of the light sensitive material or rewinding of the roll.

According to the present invention there is provided a package for a roll of light sensitive web material, the roll including a core having opposite ends and a length of light sensitive material wound around the core, the package comprising a flexible opaque leader having a leading end and a trailing end, the trailing end for attachment to the outermost end of the light sensitive material, a pair of flexible end discs adapted to cover each end of the roll of material, each end disc having a central circular opening having a diameter smaller than the inner diameter of the core, the inner diameter edge of each disc being bonded to the inner wall of the core, the outer diameter of each end disc being greater than the diameter of the roll, the outer edges of each disc being folded axially inwardly of a respective one of the end surfaces of the roll, each end disc being provided with a concentric ring of circumferentially extending perforations on the outer edges thus folded, such that when the leader is pulled and a tear is initiated in the end disc the ring controls the propagation of the tear such that substantially no ears are formed.

The package according to the invention provides important advantages over prior art packages.

The light-tight package according to the invention reduces significantly the chances of the end discs being torn inaccurately and leaving untorn portions which interfere with rewinding the package. In this respect the orientation and size of the perforations is very important, each perforation or slit extending in a circumferential manner. In the present invention the perforations do not initiate the tear but are provided to control the tear, should the tear deviate from its preferred direction. The invention enables the tearing to be controlled, uniform and clean.

The foregoing and other objects, features and advantages of the invention will be apparent from the following more particular description of the preferred embodiment of the invention as illustrated in the accompanying drawings.

DETAILED DESCRIPTION OF THE INVENTION

As certain features of, and methods of manufacturing, light sensitive web roll packages are well known the following description is directed in particular to those methods and features relating directly to the invention. Features not specifically shown or described herein can be any of those known in the prior art.

Figure 1:
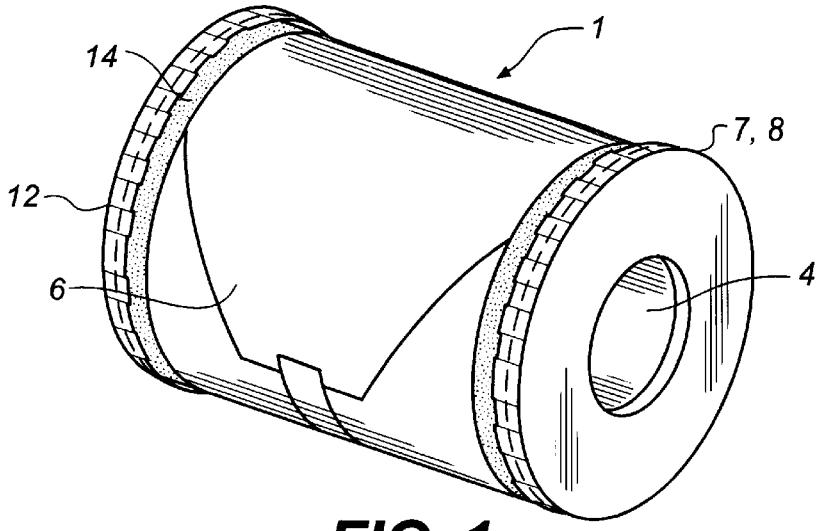
FIG. 1 is a perspective view of a package according to the present invention.
Figure 2:
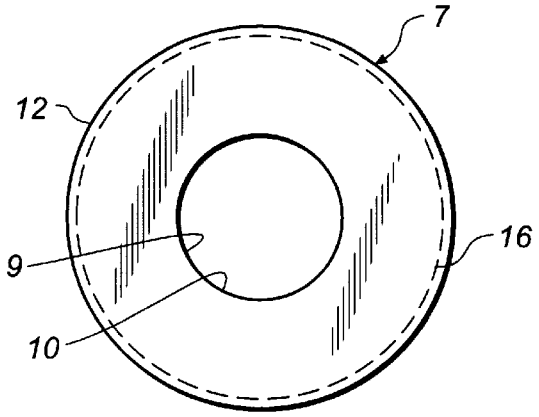
FIG. 2 shows an end disc according to the invention.
Figure 3:
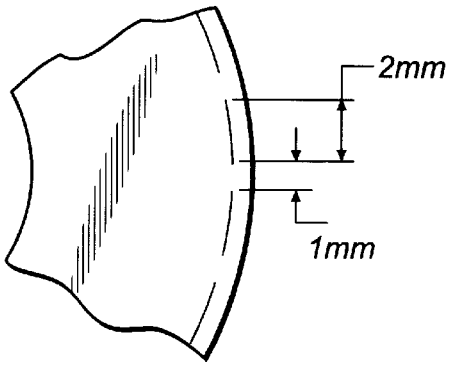
FIG. 3 is an enlarged view of the perforations applied to the end disc.

FIG. 1 shows a roll 1 of light sensitive web material such as photographic paper or film. The roll 1 includes a central hollow core 4, typically made of cardboard, having opposite ends and a length approximately equal to the width of the web. A length of web is wound onto the core 4 such that the wound roll 1 has opposite end faces. A leading end of the web is attached to a flexible, opaque leader 6. The leader 6 includes a trailing end having a width approximately equal to the width of the web material. The length of the leader is at least equal to one circumference of the roll 1 to prevent exposure of the web to light. Extra length may be included. The leader 6 may be made of any suitable opaque material, for example a polyester/polythene laminate, including a layer of black ink. The thickness would be in the region of 200 microns. Adhesion means, such as a strip tape, may be used to attach the leader to the web.

A pair of end discs, or flanges, 7, 8 are provided to cover the end surfaces of the roll 1. Each disc 7, 8 is provided with a central hole 10. The diameter of the central hole is smaller in diameter than the internal diameter of the core 4. The inner diameter portions of the discs are folded into the core and bonded thereto. The outer diameter of each end disc 7, 8 is larger than the diameter of the wound roll of web material to provide rims or peripheral portions 12. The outer diameter of each end disc is approximately 20 mm bigger than the outer diameter of the wound roll of web material. Each disc 7, 8 is provided with a concentric ring of perforations or slits 16 within the peripheral portion. The perforations are arranged such that they each extend in a circumferential direction within the concentric ring. It is important that this ring of circumferentially extending perforations is disposed on the peripheral portion of the disc that is folded axially inwardly against the outer surface of the roll. If adequate tearing does not take place the ring of perforations ensures that the size of any "ears" formed is minimised by controlling the line of tear. This ensures that satisfactory rewinding can take place later. In the particular embodiment described the ring of perforations is located approximately 5 mm from the outer edge of the disc. The perforations or slits 16 are in the order of 2 mm in length with gaps approximately 1 mm in between. The exact dimensions will depend on the size of the rolls and the nature of the material used. The perforations can be applied to the end discs by any suitable processes known to those skilled in the art, such as die-cutting.

The provision of the ring of circumferentially extending perforations or slits helps to maintain an adequate tear so that any "ears" that are formed are limited in size and do not detrimentally affect the functionality of the package. The perforations found in discs of the prior art can only initiate a tear. They do not control the tear once it is propagating.

The discs are made of an opaque, thin, flexible, laminate material. A suitable laminate could be: 12 micron polyester/adhesive/12 micron polyester/black ink/primer/12 micron LDPE/9 micron foil/25 micron DOW LDPE. The overall thickness of the discs is in the region of 0.057 mm.

In the assembled package the peripheral portions 12 of the discs are folded over the circumferential edges of the leader 6 and adhered thereto. The folded over portions of the discs 7, 8 may be held in place by strips of adhesive tape 14.

As the leader 6 unwinds from the roll it begins to tear the peripheral portions 12 from the end discs 7, 8. The ring of perforations ensures that any portions of material or "ears" formed are no larger than 5 mm and will not detrimentally effect the rewinding of the roll. The tear is thus controlled more accurately. When the leader is completely unwound the peripheral portions will have been torn from the end discs 7, 8. The provision of the ring of perforations means that the end discs are not torn in such a way that portions of material or ears are left to interfere with rewinding of the roll.

As stated earlier the invention provides numerous benefits. The provision of the concentric ring of circumferentially extending perforations controls the tearing of the discs.

The invention has been described with particular reference to a preferred embodiment. It will be understood by those skilled in the art that variations and modifications can be made within the scope of the claims.

PARTS LIST

1 roll
4 hollow core
6 opaque leader
7 flange
8 flange
10 central hole
12 peripheral portions
16 slits

What is claimed is:

1. A package for a roll of light sensitive web material, the roll including a core having opposite ends and a length of light sensitive material wound around the core, the package comprising a flexible opaque leader having a leading end and a trailing end, the trailing end for attachment to the outermost end of the light sensitive material, a pair of flexible end discs covering each end of the roll of material, each end disc having a central circular opening having a diameter smaller than the inner diameter of the core, the inner diameter edge of each end disc being bonded to the inner wall of the core, the outer diameter of each end disc being greater than the diameter of the roll, the outer edges of each end disc being folded axially inwardly of a respective one of the end surfaces of the roll, each end disc being provided with a ring of circumferentially extending perforations concentric therewith on the outer edges thus folded, such that when the leader is pulled and a tear is initiated in the end disc the ring controls the propagation of the tear such that substantially no ears are formed.

2. A package for a roll of light sensitive web material, the roll including a core having opposite ends and a length of light sensitive material wound around the core, the package comprising a flexible opaque leader having a leading end and a trailing end, the trailing end for attachment to the outermost end of the light sensitive material, a pair of flexible end discs covering each end of the roll of material, each end disc having a central circular opening having a diameter smaller than the inner diameter of the core, the inner diameter edge of each end disc being bonded to the inner wall of the core, the outer diameter of each end disc being greater than the diameter of the roll, the outer edges of each end disc being folded axially inwardly of a respective one of the end surfaces of the roll, each end disc being provided with a ring of circumferentially extending perforations concentric therewith on the outer edges thus folded, the length of each of the circumferentially extending perforations being in the order of 2 mm with a gap of approximately 1 mm in between each perforation.

3. A package according to claim 2 wherein the circumferential ring of perforations is provided approximately 4 mm to 6 mm from the outer edge of each end disc.

4. A package according to claim 1 wherein the end discs are made from a laminate material of polyester, aluminum and sealing media.

5. A package according to claim 2 wherein the end discs are made from a laminate material of polyester, aluminum and sealing media.

* * * * *